United States Patent [19]

Kaplan

[11] Patent Number: 4,611,613

[45] Date of Patent: Sep. 16, 1986

[54] DECOKING APPARATUS

[75] Inventor: Richard D. Kaplan, Flossmoor, Ill.

[73] Assignee: Standard Oil Company (Indiana), Chicago, Ill.

[21] Appl. No.: 695,904

[22] Filed: Jan. 29, 1985

[51] Int. Cl.[4] ..... B08B 3/02; B08B 9/02

[52] U.S. Cl. ..... 134/95; 134/98; 134/99; 134/167 R; 134/171; 196/122; 202/241; 239/DIG. 13; 239/186; 239/227; 239/248

[58] Field of Search ..... 134/24, 39, 95, 98, 134/99, 167 R, 167 C, 168 R, 168 C, 171, 172, 178; 201/2; 202/241; 208/48 R; 196/122; 239/DIG. 13, 178, 186, 227, 248, 447, 562, 563

[56] References Cited

U.S. PATENT DOCUMENTS

| | | | |
|---|---|---|---|
| 2,245,575 | 6/1941 | Court | 239/248 X |
| 2,306,926 | 12/1942 | Allen | 406/145 X |
| 2,355,323 | 8/1944 | Ohlinger et al. | 239/248 |
| 3,358,935 | 12/1967 | Andersen | 134/167 R X |
| 3,646,947 | 3/1972 | Rochelle et al. | 134/24 X |
| 3,880,359 | 4/1975 | Novy | 134/168 R X |
| 3,994,310 | 11/1976 | Brandon | 134/167 C |

*Primary Examiner*—Philip R. Coe

*Attorney, Agent, or Firm*—Thomas W. Tolpin; William T. McClain; William H. Magidson

[57] ABSTRACT

A specially constructed decoking apparatus is provided to effectively and efficiently bore a pilot hole and ream the remainder of a bed of coke with a high pressure stream of water or other cutting fluid without first changing nozzle heads or using different cutting instruments. The novel decoking apparatus has a vertical pilot nozzle and pilot pipe and a separate reamer and reaming pipe which are secured adjacent to each other and work in tandem.

7 Claims, 9 Drawing Figures

DECOKING APPARATUS

BACKGROUND OF THE INVENTION

This invention relates to removing residual carbon from refinery equipment and the like and, more particularly, to an apparatus for removing coke buildup in petroleum cokers.

Over the years, a variety of complex and cumbersome devices have been suggested for removing coke from petroleum cokers. Coke removal (decoking) has been conventionally accomplished by sequentially inserting and removing as many as three different decoking devices to accomplish pilot hole cutting, reaming, and a variety of other decoking operations. Typifying these decoking devices and other materials-handling devices are those shown in U.S. Pat. Nos. 1,857,766, 2,217,360, 2,245,554, 2,245,575, 2,306,926, 2,335,604, 2,355,323, 2,761,160, 3,412,012, 3,836,434, 3,880,359, 3,892,633, 4,168,224, 4,410,398, and 4,454,022. These devices have met with varying degrees of success.

It is, therefore, desirable to provide an improved decoking apparatus and process which overcomes most, if not all, of the above problems.

SUMMARY OF THE INVENTION

An improved decoking apparatus is provided which effectively, efficiently, and easily removes coke from a petroleum coker. Advantageously, the decoking apparatus is relatively easy to use and results in considerable economic and operational savings.

To this end, the novel decoking apparatus has a vertical nozzle to fluidly cut a pilot hole through a bed of coke. Radial nozzles are positioned above and transverse to the vertical nozzle to fluidly cut and remove the remaining coke in the vessel. An elongated, vertical conduit or pipe is connected to the vertical nozzle to feed a cutting fluid, such as water, to the vertical nozzle. A separate shorter vertical conduit or pipe is connected to the radial nozzles to feed a cutting fluid, such as water, to the radial nozzles. The shorter conduit is positioned substantially parallel, external, and adjacent to the longer conduit in order to position the radial nozzles above the vertical nozzle, as well as to provide for separate feed lines to the vertical and radial nozzles. One or more valves are operatively connected to the conduits to selectively control the flow of cutting fluid to the nozzles.

The decoking apparatus (instrument) is lowered into the coking vessel (petroleum coker) to cut (bore) a vertical pilot hole substantially through the bed of coke. After the pilot hole is cut, a larger hole is reamed through the bed of coke with the same decoking apparatus to remove the remainder of the coke without first removing the decoking apparatus from the vessel. After the coke is removed, the decoking apparatus is withdrawn from the vessel and coking operations are restarted.

A more detailed explanation of the invention is provided in the following description and appended claims taken in conjunction with the accompanying drawings.

DETAILED DESCRIPTION OF THE PREFERRED EMBODIMENT

Figure 1:
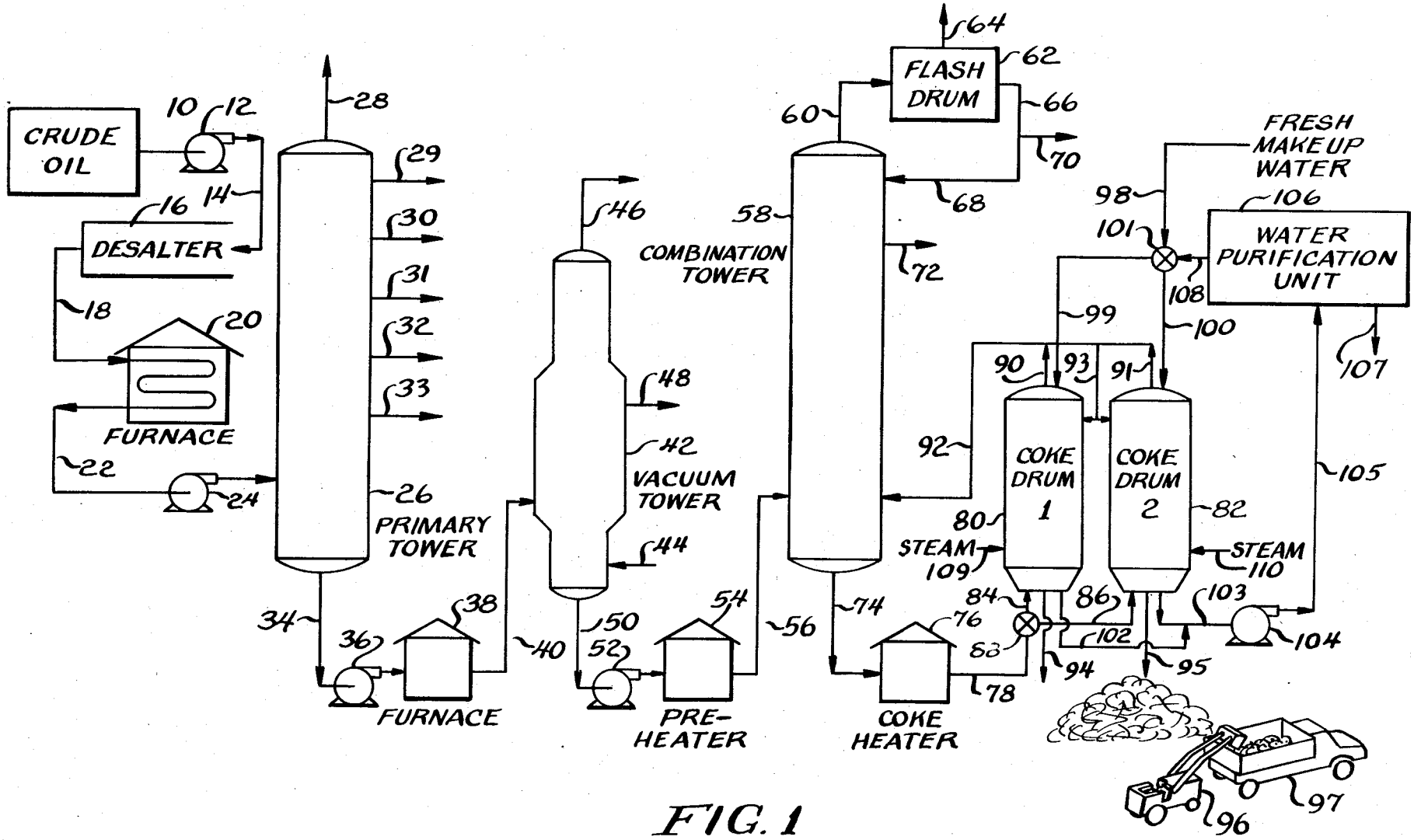
FIG. 1 is a schematic flow diagram of refining and coking operations.

In refining and coking operations (FIG. 1), crude oil (petroleum) is withdrawn from an aboveground storage tank 10 by a pump 12 and pumped through feed line 14 into one or more desalters 16 to remove particulates, such as sand, salt, and metals, from the oil. The desalted oil is fed through furnace inlet line 18 into a pipestill furnace 20 where it is heated to a temperature, such as to 750° F. at a pressure ranging from 125 to 200 psi. The heated oil is removed from the furnace through exit line 22 by a pump 24 and pumped to a primary distillation tower 26.

The heated oil enters the flash zone of the primary tower 26 before proceeding to the upper rectifier section or the lower stripper section of the primary tower. The primary tower is preferably operated at a pressure less than 60 psi. In the primary tower, the heated oil is separated into fractions of wet gas, light naphtha, intermediate naphtha, heavy naphtha, kerosene, virgin gas oil, and primary reduced crude. A portion of the wet gas, naphtha, and kerosene is preferably refluxed (recycled) back to the primary tower to enhance yield and efficiency.

Wet gas is withdrawn from the primary tower 26 through overhead wet gas line 28. Light naphtha is removed from the primary tower through light naphtha line 29. Intermediate naphtha is removed from the primary tower through intermediate naphtha line 30. Heavy naphtha is withdrawn from the primary tower 26 through heavy naphtha line 31. Kerosene and oil for producing jet fuel and furnace oil are removed from the primary tower through kerosene line 32. Virgin gas oil is removed from the primary tower through virgin gas oil line 33.

Primary reduced crude is discharged from the bottom of the primary tower 26 through the primary reduced crude line 34. The primary reduced crude in line 34 is pumped by pump 36 into a furnace 38 where it is heated, such as to a temperature of about 750° F. The heated primary reduced crude is conveyed through a furnace discharge line 40 into the flash zone of a pipestill vacuum tower 42.

The vacuum tower 42 is preferably operated at a pressure ranging from 35 to 50 mm of mercury. Steam is injected into the bottom portion of the vacuum tower through steam line 44. In the vacuum tower, wet gas is withdrawn from the top of the tower through overhead wet gas line 46. Heavy gas oil is removed from the middle portion of the vacuum tower through heavy gas oil line 48. Vacuum reduced crude is removed from the bottom of the vacuum tower through vacuum reduced crude line 50. The vacuum reduced crude has an initial boiling point of about 1000° F. and can be used for producing asphalt, residual fuel, and coke. The vacuum reduced crude, also referred to as resid, is pumped from vacuum reduced crude line 50 by a pump 52 into a preheater furnace 54 where it is heated before being conveyed through preheater discharge line 56 into a distillation tower 58, also referred to as a combination tower.

The combination tower 58 is operated at suitable operating conditions, such as a pressure of 20 psia and a temperature of about 760° F., to produce gas, coke still, naphtha, and coke still gas oil. Gas is withdrawn from the combination tower through an overhead gas line 60 and conveyed to a flash drum 62 where it is separated into wet gas and coke still naphtha. The wet gas is removed from the upper portion of the flash drum through a wet gas line 64. The coke still naphtha is removed from the flash drum through coke still naphtha line 66. Some of the coke still naphtha is refluxed back to the combination tower 58 through a naphtha reflux line 68. Most of the coke still naphtha is transported downstream for further use through a naphtha product line 70. Coke still gas oil is removed from the combination tower through coke still gas oil line 72. Coke still resid oil is removed from the bottom of the combination tower through resid line 74 at a temperature of about 650° F. to about 700° F. and conveyed to a coke heater or coking furnace 76 where it is heated to a temperature, such as to about 900° F. to about 950° F.

The heated resid exits the coking furnace 76 through a furnace exit line 78 where it is fed to two or more coke drums 80 and 82 through feed lines 84 and 86. One or more control valves 88 control the flow of heated resid oil to the coke drums.

During coking, as more fully explained below, the residual oil is heated under coking conditions to produce coke. The coke drums are preferably operated at a pressure from about 10 psig to about 50 psig. Vapors/gases produced during coking are withdrawn through overhead gas lines 90 and 91 and recycled to the combination tower 58 through recycle line 92. Some of the vapor/gases produced during coking are withdrawn through gas line 93 and fed to the other coke drums after decoking for reheating. As coke (residual carbon) is produced in the coke drum, the coke builds up and substantially fills the drum. The built-up coke product must be removed from the coke drum in a process referred to as decoking in order to obtain the coke and clean out the coke drum. The purpose of having more than one coke drum is to be able to take at least one of the coke drums off stream for decoking operations while keeping the other coke drum on-stream during coking to assure continuous refining and coking. The coke is removed from the bottom of the coke drums through discharge chutes or conduits 94 and 95 where it can be accumulated in a pile and removed by bulldozers 96, trucks 97, and/or other materials-handling equipment. If desired, the coke can also be removed by railway cars or be conveyed to other locations through coke-slurry pipelines.

Coke has many uses. Needle coke is used as electrodes in electric furnaces for the processing of steel. Needle coke can be produced from a highly aromatic charge stock with little or no asphaltenes. Coke used for the production of electrodes preferably has a relatively low electric resistance, a low coefficient of thermal expansion, and high mechanical strength. Low sulfur coke is used in reduction furnaces for the processing of aluminum and can be used as an industrial fuel. High sulfur coke is used as a fuel in Europe and elsewhere.

During decoking, fresh make-up water in fresh water line 98 is injected into the coke drums through water lines 99 and 100. One or more water control valves 101 control the flow of water into the coke drums. The effluent water from decoking operations is discharged from the bottom of the coke drums through effluent water lines 102 and 103 where it is pumped by a pump 104 through an effluent water line 105 to one or more water purification units 106. The water purification unit removes coke and other particulates from the effluent water. The removed coke and particulates are discharged from the bottom of the water purification unit through a discharge line 107 and are accumulated in a pile or transported to the other coke pile for subsequent removal by the trucks and/or the other materials-handling equipment. Purified water is discharged from the water purification unit through a purified water line 108 and fed to water line 99 or 100 during decoking. One or more control valves 101 control the flow of the purified water into the coke drums. The water purification unit can include settlers, clarifiers, steam strippers, granular bed filters, adsorbers, and/or other appropriate water purifying equipment.

Commercial coking cycles range from 16 hours or less to about 36 hours. During a typical coking cycle, one of the coke drums is operated in a coking mode for about 16 hours. Meanwhile, another coke drum is cooled for about 5 hours, drained of water for about 1 hour, decoked for about 4 hours, tested for about 1 hour, and heated for about 5 hours preparatory to being operated in a coking mode.

During the cooling mode, steam is injected into the coke drums through steam lines 109 and 110 to strip the lighter hydrocarbons out of the coke drums. The lighter hydrocarbons are removed through gas lines 90 and 91 and recycled to the combination tower. The steam injector can be operated at a flow rate such as about 2,000 lbs/hr. After steam stripping, steam is injected through the steam injectors at a much greater rate, such as at about 20,000 lbs/hr to partially cool the coke in the bottom portion of the coke drum. A relatively low flow rate of water, such as about 50 gpm, is fed into the coke drums through water lines 99 and 100 while reducing the steam flow. After the steam flow has been shut off, the flow of water is substantially increased, such as to about 1,000 gpm, to cool the coke. When the water in the coke drums stops boiling, the coke is sufficiently cooled and the water is drained from the bottom of the coke. After decoking, steam is again injected into the coke drums through the steam lines 109 and 110 to purge the coke drums of air and test for leaks. Thereafter, the coke drum is heated, such as with the hot vapors/gases from gas line 93 emitted from the other coke drum during coking, preparatory to coking.

Coke drums built before 1940 averaged about 10 feet in diameter and about 40 feet high. Coke drums built between 1946 and 1952 typically had diameters ranging in size from 17 feet to 20 feet. Newly built coke drums now have diameters as much as 26 feet or more with heights ranging to as much as 110 feet or more. Coke drums fabricated today can have an 11–13 chrome lining that is 7/64 inch thick. This type of lining on carbon or low alloy steels has replaced liners applied by resistance welds, as well as flow-through and strip lining. Satisfactory backing material can be carbon steel SA-285, carbon silicon steel SA-201, or various other alloy carbon steels.

Figure 2:
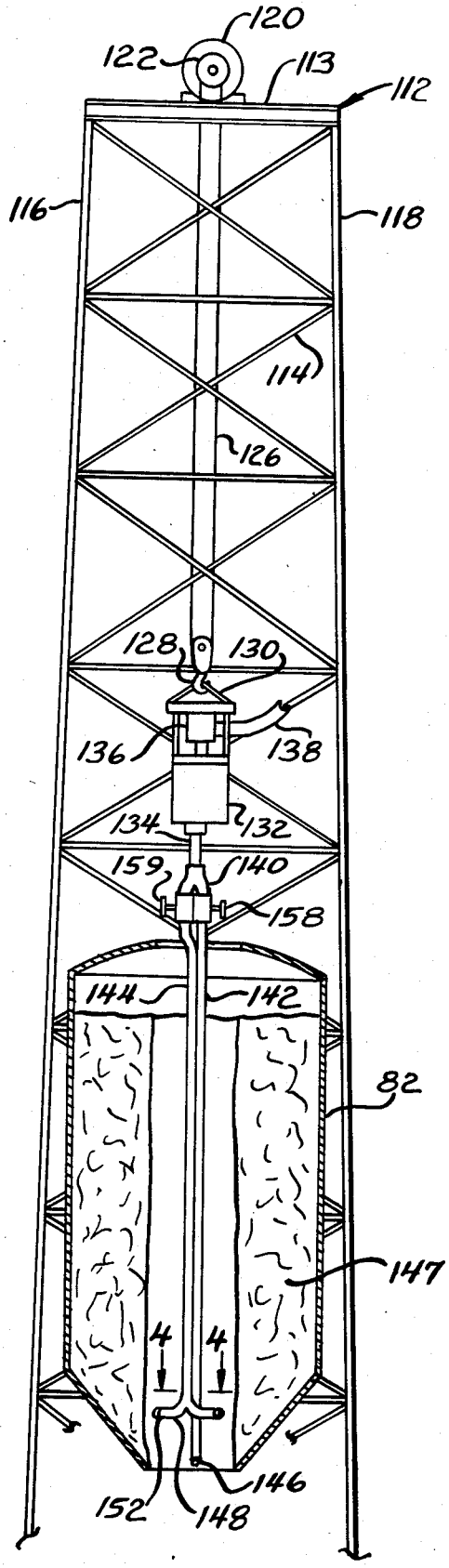
FIG. 2 is a front view of a decoking apparatus in accordance with principles of the present invention.

As shown in FIG. 2, the coke drum 82 is supported and firmly secured to a superstructure 112 comprising an upright frame assembly. The frame assembly has horizontal beams 113, crossbars and diagonal braces 114 along with upright columns or posts 116 and 118. A power-driven hoist 120, which is powered by a motor or internal combustion engine, or is pneumatically powered, is mounted on the top horizontal beam of the superstructure. The hoist has a wheel or pulley 122 which raises and lowers a cable 126 having a grasping hook 128 at its lower end. The grasping hook is connected to bail 130 which carries a horizontally rotatable motor 132.

A vertical feed pipe or line 134 is secured to and extends downwardly from the interior middle portion of the motor 132. The upper portion of the feed line 134 is rotatably connected by ball bearings or the like to a swivel coupling and joint 136 which is connected to and communicates with a water supply line 138. The water supply line supplies and feeds water or other cutting fluid from a supply tank to the feed line 134. A bifurcated, inverted U-shaped joint 140 is connected to the bottom of the feed pipe 134. Extending downwardly from the bifurcated joint is a vertical pilot pipe 142 and a substantially vertical reaming pipe 144. The pipes, motor, cable, and hoist are mounted substantially along the vertical centerline of the coking vessel 82 so that the pipes 142 and 144 can be lowered along the vertical axis of the coking vessel, after the top and bottom access lid, flanges, hatches, or doors of the coking vessel are removed or opened for decoking operations.

Figure 4:
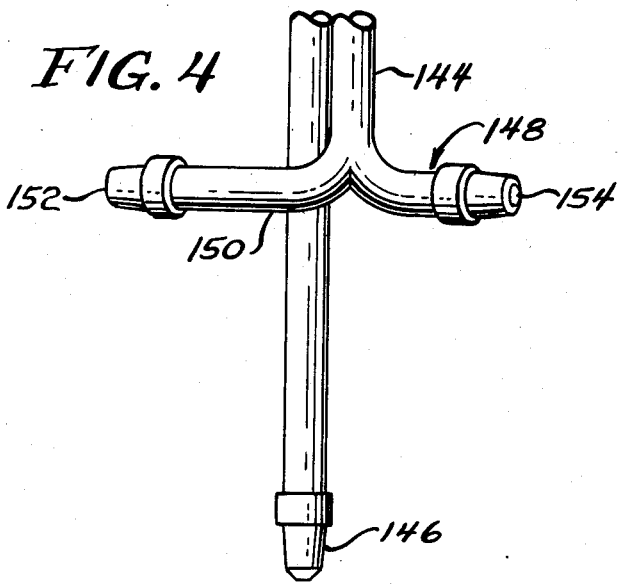
FIG. 4 is an enlarged front view of the bottom portion of the decoking apparatus taken substantially along line 4—4 of FIG. 2.

The bottom of the pilot pipe has a downwardly facing, vertical pilot pipe-nozzle 146 as best shown in FIG. 4. The pilot pipe-nozzle 146 is also sometimes referred to as a cutting nozzle, boring nozzle, or pilOt nozzle. The pilot nozzle injects water downwardly at a sufficient pressure to form, cut, bore, and/or drill a pilot hole substantially vertically through the center and along and about the vertical axis of the bed of coke 147 in the coking vessel.

Figure 3:
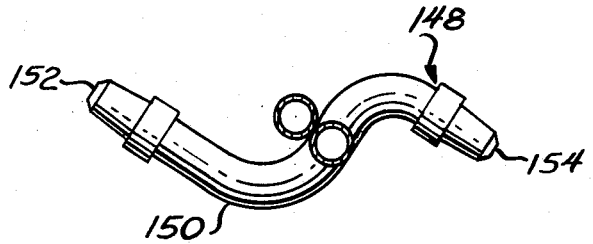
FIG. 3 is an enlarged bottom view of the radial nozzles of the decoking apparatus.

The bottom end of the reaming pipe 144 has a reamer 148. The reamer is positioned generally above and substantially perpendicular to the downwardly facing pilot nozzle 146. The reaming pipe 144 is fixedly positioned by the U-shaped joint 140 so as to be substantially parallel and adjacent to, as well as externally outwardly of, the pilot pipe 142. The reaming pipe is shorter than the pilot pipe to position the reamer 148 substantially above the pilot nozzle. The reamer 148 has a generally S-shaped conduit 150, as shown in FIG. 3, which is connected to radially outwardly-facing, offset reaming nozzles 152 and 154. The radial nozzles 152 and 154 of the reamer inject water radially outwardly at a sufficient pressure to ream and remove the remaining coke adhering to the walls of the vessel. When operated in the preferred manner, the reamer removes substantially all the coke deposited in and along the walls of the coking vessel.

A pilot flow control valve 158 is operatively connected to the pilot pipe to control the flow of water to the pilot pipe 142 and pilot nozzle 146. A reaming control valve 159 is operatively connected to the reaming pipe to control the flow of water to the reaming pipe 144 and reamer 148. In the illustrative embodiment, the valves are connected to the pipes adjacent to the inverted U-shaped joint 140.

Figure 5:
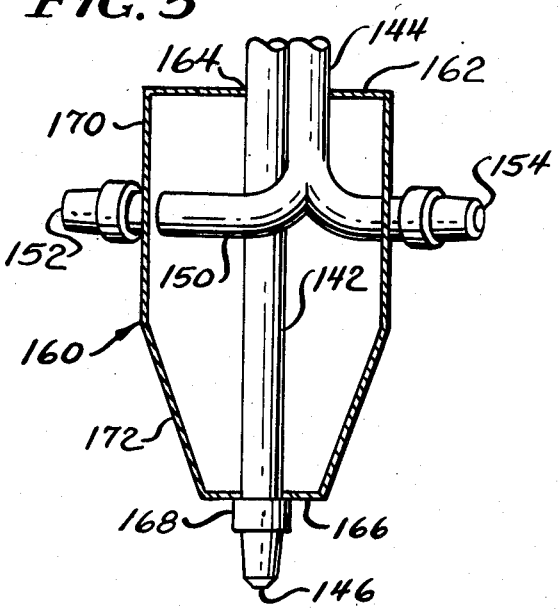
FIG. 5 is a cross-sectional view of a protective housing covering a portion of the bottom portion of the decoking apparatus.
Figure 6:
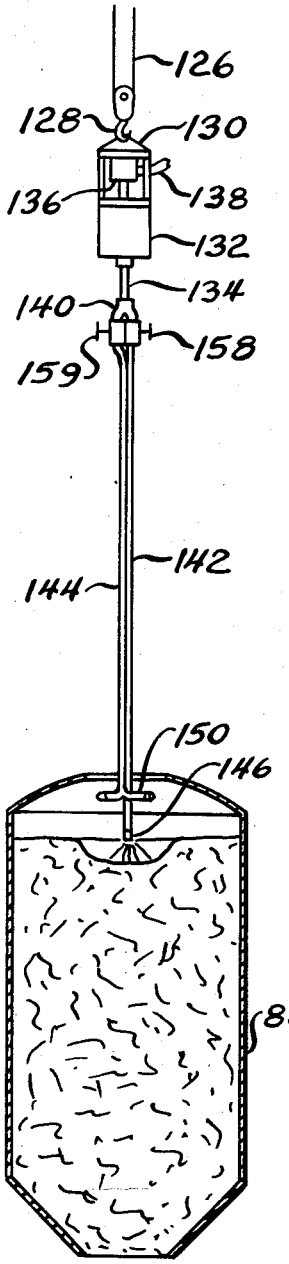
FIGS. 6–9 illustrate the sequence of steps in the decoking process in accordance with principles of the present invention.
Figure 7:
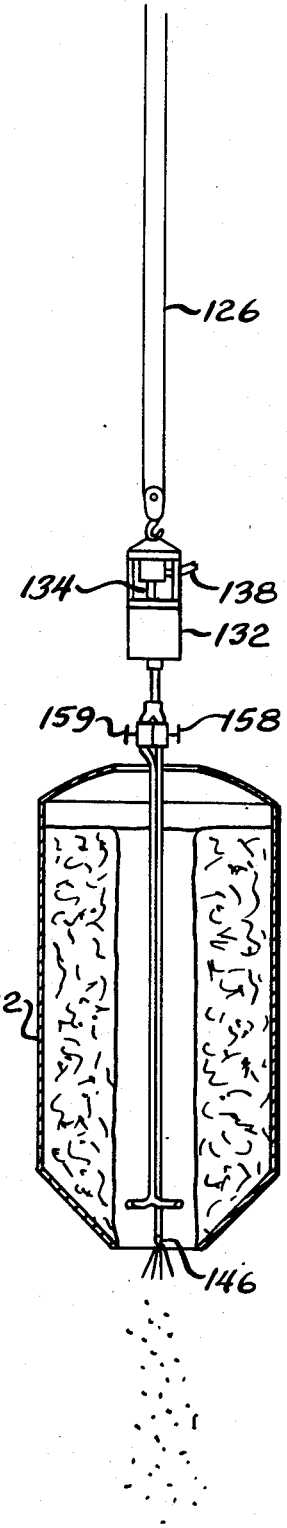
Figure 8:
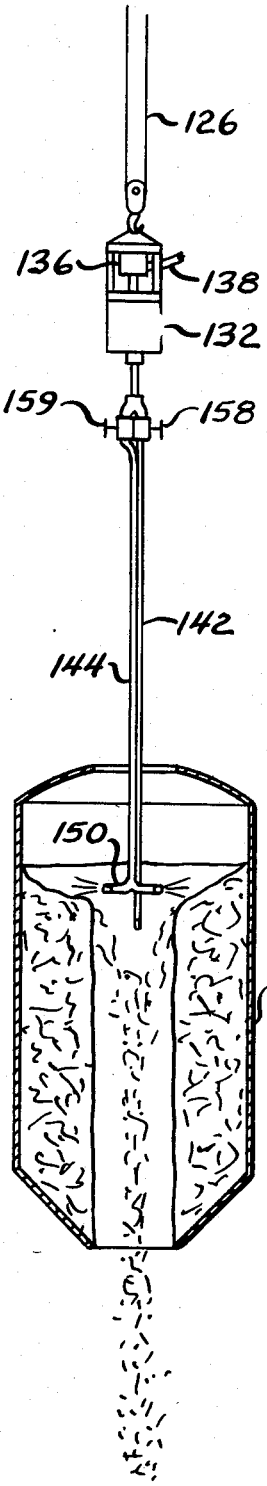
Figure 9:
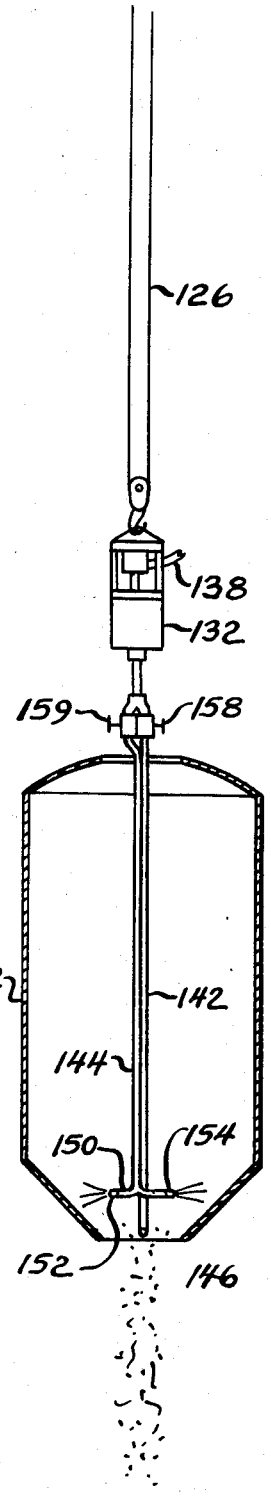

In some circumstances it may be desirable that the S-shaped conduit 150 and the bottom portion of the pilot pipe 142 be protectively covered by a housing 160 as shown in FIG. 5. The housing has a large circular top 162 with an offset access hole or opening 164 for passage of the pilot pipe 142 and reaming pipe 144. The housing also has a smaller, circular horizontal bottom portion 166 with a central access hole or opening 168 for receiving the pilot pipe. Vertical walls 170 extend downwardly from the top of the housing and have openings therein for receiving the S-shaped conduit 150. Frustoconical barrier walls 172 extend downwardly from the vertical walls 170 and are connected to and converge toward the bottom portion of the housing.

The sequence of steps in the decoking operation is shown in FIGS. 6–9. During decoking, the pilot nozzle 146 and reamer 150, providing part of the decoking instrument, are lowered into the top portion of the coking vessel after the top and bottom access lids, flanges, hatches, or doors of the coking vessel are removed or opened. The pilot control valve 158 is then opened and a circulating fluid, preferably water, is injected downwardly through the pilot nozzle 146 at a pressure ranging from 500 psi to about 3,500 psi, preferably at least 2,000 psi, at a flow rate of 750 gpm to 2,500 gpm to cut a pilot hole through the vertical axis of the bed of coke as the pilot nozzle 146 and pilot pipe 142 are sequentially lowered through the axis of the coking vessel by the cable 126 with the hoist. The coke being cut, drilled, and/or bored by the pilot nozzle is discharged through the bottom of the coking vessel.

After the pilot hole has been cut through the center of the coke, the pilot control valve 158 is shut off to stop the flow of water to the pilot nozzle. Thereafter, the reaming control valve 159 is opened to feed the cutting fluid, preferably water, to the reamer at a pressure ranging from 500 psi to 3,000 psi, preferably at least 2,000 psi, at a flow rate of 750 gpm to 2,500 gpm. As the coke is reamed upwardly from the bottom to the top of the coke bed, the cutting tool is raised with the aid of the cable from the hoist until it reaches the top of the coke bed. Alternatively, the coke may be reamed from the top down.

The movement and torque created by the water pressure on the reamer will cause the reamer to rotate horizontally. In the preferred embodiment, the motor 132 is activated and energized to rotate and control the horizontal rotational speed of the reamer at a much faster rate.

The injection pressure of the water is sufficient so that the reaming nozzles substantially remove and ream the remaining bed of coke in the coking vessel as the reamer is sequentially moved through the decoking vessel along its vertical axis by the cables of the hoist. After all the coke has been removed from the coking vessel, the reaming valve is closed to shut off the supply of water to the reamer and the motor 132 is shut off and deactivated to stop rotation of the reamer. Thereafter, the reaming pipe 144, reamer 150, pilot pipe 142, and pilot nozzle, providing the bottom portion of the decoking instrument and apparatus, are raised, withdrawn, and removed from the top of the coking vessel by raising the cable with the hoist. The top and bottom lids, hatches, or doors of the coking vessel are then closed and secured to the coking vessel so that the coking vessel can be purged with steam, tested, and preheated preparatory to coking as previously described.

In some circumstances it may also be desirable to rotate the pilot nozzle when cutting, drilling, and/or boring the pilot hole. This can be accomplished by activating the motor during cutting of the pilot hole. The rotational speed of the pilot nozzle during cutting of the pilot hole, as well as the rotational speed of the reamer during reaming, can be selected by the operator and is dependent on the density, compactness, size, and composition of the coke.

The diameter of the cutting hole can be regulated by the operator by varying the water pressure, downward velocity, and rotational speed of the pilot nozzle. A pilot hole of 2–3 feet is often used, although smaller or larger pilot holes are also acceptable.

The reamer cuts a hole that extends to the walls of the coking vessel so as to substantially remove all the coke deposits in the coking vessel. For best results, it is preferred that there is only one pilot nozzle and two radial nozzles, although it may be desirable in some circumstances to have more nozzles.

The coking apparatus and process of this invention has numerous advantages. It is efficient, effective, and easy to use. It requires less manpower to operate and less downtime because it avoids the need to insert different cutting, reaming, boring and other decoking tools as well as avoids the necessity of replacing or exchanging reaming, drilling, and cutting heads during decoking as is common in prior art methods.

If the nozzles forming the head of the coking instrument become stuck in the coke, the water can be diverted to or alternated between the pilot pipe and the reaming pipe or fed simultaneously through the pilot and reaming pipes by opening and/or closing the pilot and reaming control valves as appropriate. The ability to divert and alternate the water between the pilot and reaming pipes is not only useful to free the cutting head if it gets stuck, but is also useful to open the pilot hole if it gets blocked during decoking. Unblocking can also be enhanced by rotating (reversing) the motor in the opposite direction while simultaneously raising the cutting head and reamer with the cable of the hoist.

While the decoking apparatus and process of this invention is particularly useful for coking vessels, it can also be useful for decoking and removing residual carbon from synthetic fuel retorts, such as oil shale retorts.

Although embodiments of this invention have been shown and described, it is to be understood that various modifications and substitutions, as well as rearrangements of parts, equipment, and/or process steps, can be made by those skilled in the art without departing from the novel spirit and scope of this invention.

What is claimed is:

1. A decoking apparatus, comprising:

a substantially vertical nozzle for fluidly cutting a pilot hole through a bed of coke;

radial nozzles positioned generally above and transverse to said vertical nozzle for fluidly cutting and removing substantially all of the remaining bed of coke after the pilot hole has been cut;

first elongated substantially vertical conduit means connected to said vertical nozzle for feeding a cutting fluid to said vertical nozzle;

second elongated substantially vertical conduit means having a length shorter than said first conduit means for positioning said radial nozzles generally above said vertical nozzle, said second conduit means being positioned substantially parallel, external, and adjacent to said first conduit means and connected to said radial nozzles for feeding a cutting fluid to said radial nozzles; and valve means operatively connected to said first and second conduit means for selectively controlling the flow of cutting fluid to said vertical nozzle and said radial nozzles.

2. A decoking apparatus in accordance with claim 1 including means for transversely rotating said radial nozzles and said second elongated vertical conduit means.

3. A decoking apparatus in accordance with claim 1 including reciprocating power means for raising and lowering said vertical and radial nozzles and said first and second elongated, vertical conduit means.

4. A decoking apparatus in accordance with claim 1 including a flared housing for protectively covering the lower portion of said first and second elongated, vertical conduit means at a location generally adjacent said vertical and radial nozzles.

5. A decoking apparatus in accordance with claim 1 wherein said radial nozzles comprise offset nozzles and a transverse, generally S-shaped conduit extending between and connecting said offset nozzles to said second vertical conduit means.

6. A decoking apparatus, comprising:

a superstructure comprising an upright frame assembly extending above a coking vessel;

downwardly facing nozzle means for injecting water generally downwardly at a sufficient pressure to form a vertical pilot hole substantially through the center and along the vertical axis of a bed of coke deposited in said coking vessel;

a pilot pipe extending upwardly from said downwardly facing nozzle means;

reaming means positioned above and substantially perpendicular to said downwardly facing nozzle means, said reaming means including a generally S-shaped conduit with radially outwardly facing nozzles for injecting water radially outwardly at a sufficient pressure to ream substantially all of the remaining coke in said vessel;

a reaming pipe extending upwardly from said reaming means, said reaming pipe being fixedly positioned substantially parallel and adjacent to and externally outwardly of said pilot pipe, said reaming pipe being shorter than said pilot pipe for positioning said reaming means substantially above said nozzle means;

water supply means communicating with said pilot and reaming pipes for feeding water to said nozzle and reaming means;

a pilot flow control valve operatively connected to said pilot pipe for controlling the flow of water to said nozzle means;

a reaming control valve operatively connected to said reaming pipe for controlling the flow of water to said reaming means;

motor means positioned above and operatively connected to said pilot and reaming pipes for rotating said pipes about the vertical axis of said coking vessel;

hoist means mounted upon said superstructure and connected to said motor means for lowering and raising said pipes and said reaming and nozzle means together into and out of said coking vessel.

7. A decoking apparatus in accordance with claim 6 including generally frustoconical barrier walls providing a housing for protectively covering said S-shaped conduit and a bottom portion of said pilot pipe.

* * * * *